US006962522B1

(12) United States Patent
Kawasaki et al.

(10) Patent No.: US 6,962,522 B1
(45) Date of Patent: Nov. 8, 2005

(54) BARREL POLISHING DEVICE

(75) Inventors: Shuji Kawasaki, Hamamatsu (JP); Naomichi Otani, Tomakomai (JP); Kazuo Yamaguchi, Tomakomai (JP); Akira Yokoyama, Tomakomai (JP)

(73) Assignees: BBF Yamate Corporation, Shizuoka (JP); Toyota Jidousha Hokkaidou Kabushikikaisha, Hokkaido (JP)

( * ) Notice: Subject to any disclaimer, the term of this patent is extended or adjusted under 35 U.S.C. 154(b) by 0 days.

(21) Appl. No.: 10/844,207

(22) Filed: May 12, 2004

(51) Int. Cl.[7] ..... B24B 19/00
(52) U.S. Cl. ..... 451/113; 451/104
(58) Field of Search ..... 451/113, 74, 104, 451/106, 107, 326, 327, 328, 329, 330

(56) References Cited

U.S. PATENT DOCUMENTS 3,581,440 A 6/1971 McKinney et al.
3,589,071 A 6/1971 Hirschborn
3,623,278 A 11/1971 Schwartz
4,173,851 A * 11/1979 Higashi ..... 451/36
4,205,487 A 6/1980 Aderson et al.
4,615,145 A * 10/1986 Matsumoto et al. ..... 451/106
5,857,901 A * 1/1999 LaPoint ..... 451/113
6,406,356 B1 * 6/2002 Brooks ..... 451/36

* cited by examiner

*Primary Examiner*—Dung Van Nguyen
(74) *Attorney, Agent, or Firm*—Muramatsu & Associates

(57) ABSTRACT

A barrel polishing device for polishing a workpiece having a relatively complicated shape such as a vehicle wheel. The barrel polishing device comprises a polishing medium storage tank for storing polishing media, a base, a workpiece supporting shaft mounted on the base, and a workpiece detachably mounted on a tip part of the workpiece supporting shaft, the polishing media stored in the polishing medium storage tank being flowed by an appropriate means, and the workpiece supporting shaft being disposed so that a front side of the workpiece opposes the flow of the polishing media, the workpiece supporting shaft being rotated about an axis thereof, and a baffle member being placed in the vicinity of a back side of the workpiece.

6 Claims, 4 Drawing Sheets

BARREL POLISHING DEVICE

TECHNICAL FIELD

This invention relates to a barrel polishing device which is used for barrel polishing, for example, a vehicle wheel.

BACKGROUND ART

Conventionally, when a vehicle wheel is to be barrel polished, it was an ordinary practice that the front side of the vehicle wheel is arranged in such a manner as to oppose to the flow of polishing media in the state slanted forward, and the side of the vehicle wheel is polished by flowing the polishing media along the front side of the vehicle wheel while rotating the vehicle wheel (about the axis).

The polishing media, which have polished the front side, are turned from the perimeter of the vehicle wheel and stored in the back.

In this conventional barrel polishing method, however, the back of the vehicle wheel is difficult to polish because the polishing media stored in the back side of the vehicle wheel are flown away backward while turning by the turning force of the vehicle wheel.

It is, therefore, an object of the present invention to overcome the above-mentioned inconvenience.

SUMMARY OF THE INVENTION

In order to overcome the above-mentioned inconvenience, the inventor of the present invention made extensive research and development and accomplished this invention.

According to the present invention, there is provided a barrel polishing device comprising a polishing medium storage tank for storing polishing media, a base, a workpiece supporting shaft mounted on the base, and a workpiece detachably mounted on a tip part of the workpiece supporting shaft, the polishing media stored in the polishing medium storage tank being flowed by an appropriate means, and the workpiece supporting shaft being disposed so that a front side of the workpiece opposes the flow of the polishing media, the workpiece supporting shaft being rotated about an axis thereof, and a baffle member being placed in the vicinity of a back side of the workpiece. Accordingly, the flow of the polishing media stored in the back side of the workpiece is interfered with the baffle. Consequently, the surface pressure of the polishing media with respect to the back side of the workpiece can be increased.

Thus, in this barrel polishing device, since both the front and back sides of the workpiece can be polished simultaneously, the polishing efficiency of the barrel polishing for the workpiece can easily be enhanced.

Moreover, since the entire workpiece is simultaneously polished, the surface of the workpiece is activated. As a result, the coating adhesion, which is to be taken place in the succeeding process, is enhanced. In addition, since the surface hardening of the workpiece is caused by the polishing media, the workpiece is enhanced in strength.

If the workpiece is provided with a window, the corner parts of the back side of this window can be simultaneously polished in the shape of an R, the coating thickness in the succeeding process can be uniformed. As a result, generation of rust can be prevented and strength can be enhanced by preventing concentration of stress.

If the baffle member is capable of advancing and retracting with respect to the back side of the workpiece, the spacing between the back side of the workpiece and the baffle member is adjustable and therefore, the surface pressure of the polishing media with respect to the back side of the workpiece can be adjusted. Thus, the application range can be expanded.

If the baffle member is formed of an elastic material, since the baffle member is swung, the endurance of the baffle member can be maintained even if the flow pressure of the baffle member (at the back side of the workpiece), which is turned and flowed together with the workpiece, is changed.

If the baffle member is formed in the shape of a tongue, since the swinging can be made more easily, the endurance of the baffle member can be maintained over a longer period of time.

If an outer configuration of the baffle member is generally coincident with a configuration of the back side of the workpiece, since the surface pressure of the polishing media with respect to the back side of the workpiece can be maintained generally at a constant level, uniformed polishing can be carried out.

If the baffle member is placed in the vicinity of a lower part of the back side of the workpiece, the flow of the polishing media stored in a lower side of the back side of the workpiece is interfered with the baffle. As a result, the surface pressure of the polishing media with respect to the back side at the lower part of the workpiece can be increased.

DETAILED DESCRIPTION OF THE INVENTION

In the embodiments to be described hereinafter, a "vehicle wheel" will be employed as one example of a workpiece.

Figure 1:
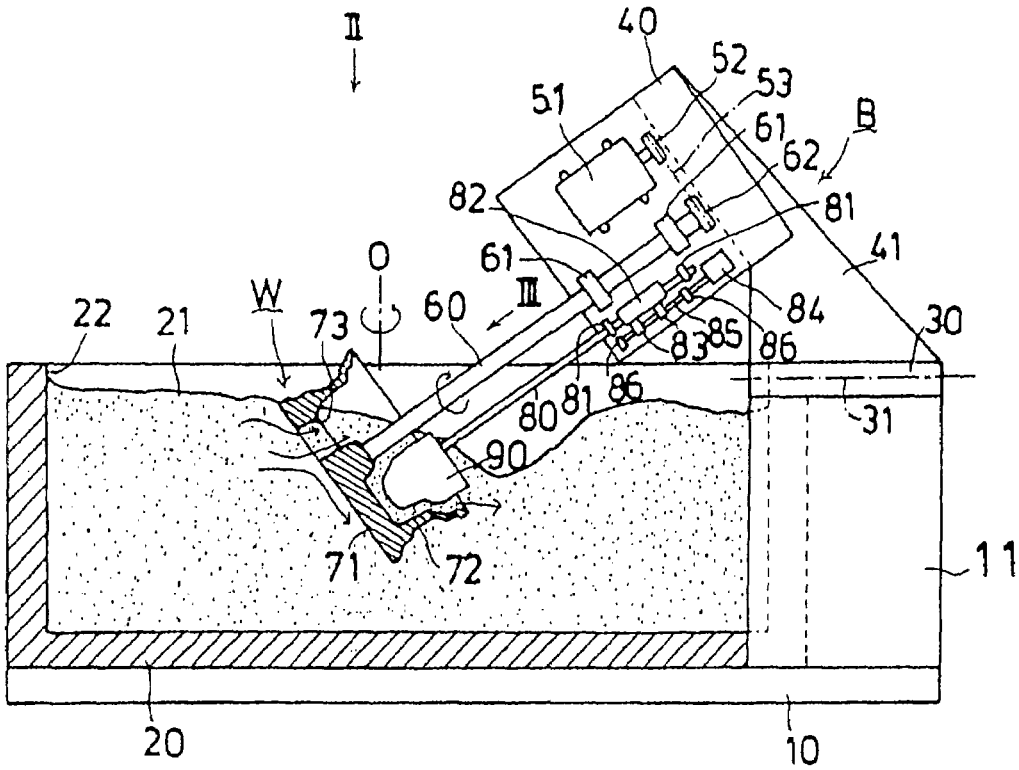
FIG. 1 is a sectional view of a barrel polishing device according to one embodiment of the present invention.
Figure 2:
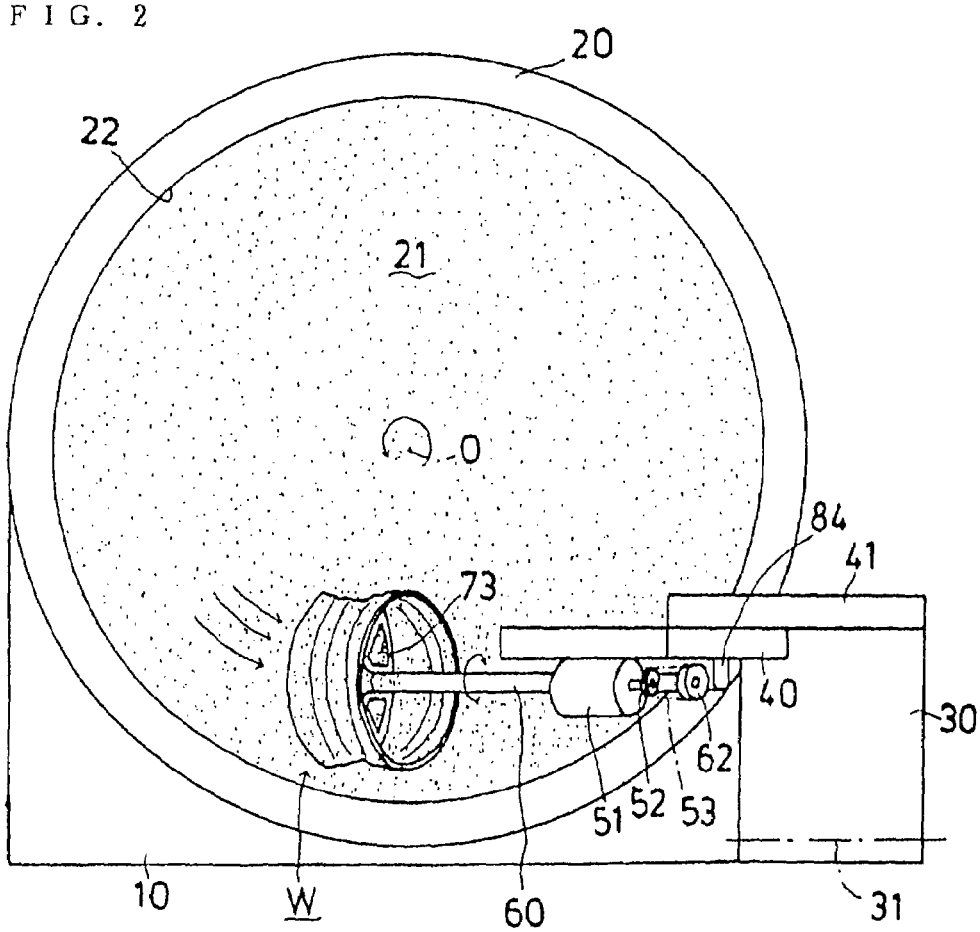
FIG. 2 is a view when viewed in a direction as indicated by an arrow II of FIG. 1.
Figure 3:
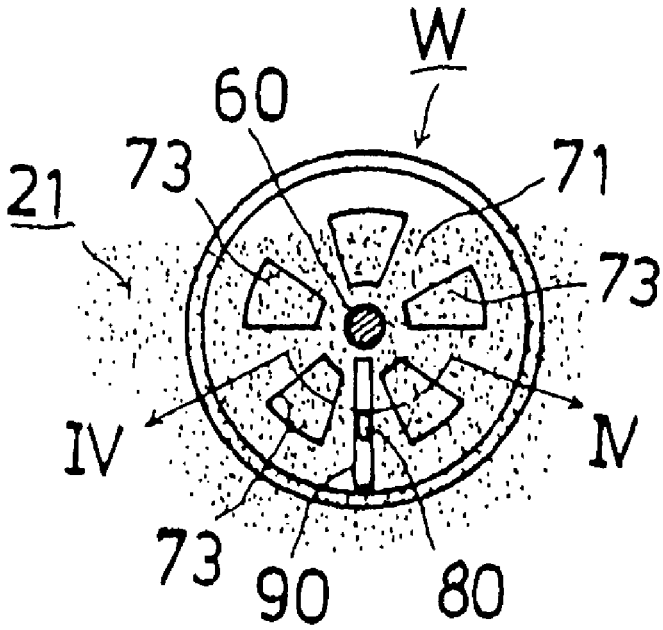
FIG. 3 is a view when viewed in a direction as indicated by an arrow III of FIG. 1.
Figure 4:
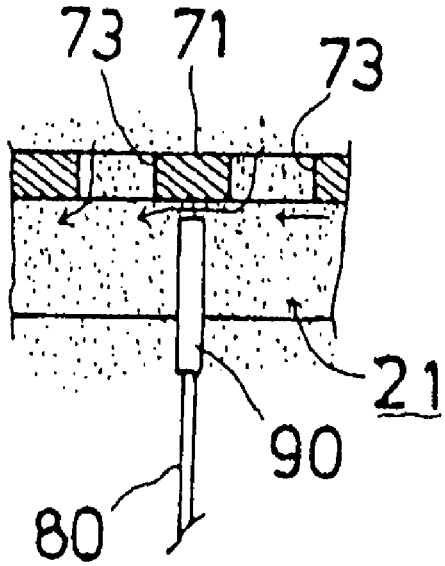
FIG. 4 is a sectional view taken on line IV—IV of FIG. 3.
Figure 5:
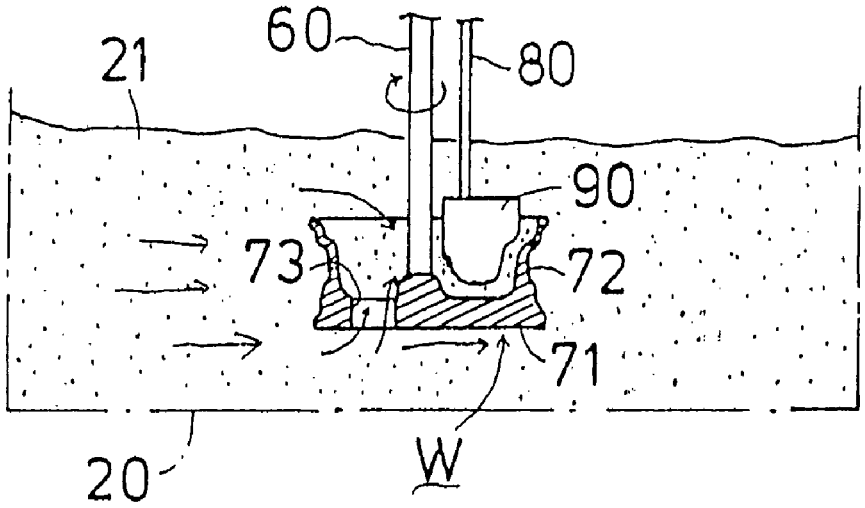
FIG. 5 is a view like FIG. 1 but showing another embodiment of the present invention.

FIG. 1 is a sectional view of a barrel polishing device according to one embodiment of the present invention, FIG. 2 is a view when viewed in a direction as indicated by an arrow II of FIG. 1, FIG. 3 is a view when viewed in a direction as indicated by an arrow III of FIG. 1, FIG. 4 is a sectional view taken on line IV—IV of FIG. 3, and FIG. 5 is a view like FIG. 1 but showing another embodiment of the present invention.

In FIGS. 1 and 2, reference symbol B denotes a barrel polishing device and 10 denotes its base. Reference numeral 20 denotes a polishing media storage tank which is mounted on the base 10. This polishing media storage tank 20 is in the shape of a circular cylinder. The polishing media storage tank 20 is turnable in a peripheral direction about an axis O by an appropriate turning means (see an arrow of FIG. 1, indicating the turning direction about the axis O). Reference numeral 21, 21, . . . denote polishing media which are stored in this polishing media storage tank 20. In accordance with the turn of the polishing media storage tank 20 in the peripheral direction, the polishing media 21, 21, . . . are flown in the same direction. As the polishing media 21, 21, . . . , those normally used, such as ceramics, may be used. The polishing method may be either wet or dry type polishing.

Reference numeral 22 denotes an upper end opening of the polishing media storage tank 20. Through this upper end opening 22, an aluminum-made vehicle wheel (corresponding to the "workpiece" of the present invention) W as later described is dipped into the polishing media 21, 21, . . . .

Reference numeral 11 denotes a supporting frame which is raised from the base 10. This supporting frame 11 extends generally to the upper end of the polishing media storage tank 20.

Reference numeral 30 denotes a reversible plate which is mounted on the supporting frame 11 through a rotation shaft 31. This reversible plate 30 is reciprocally reversible in the range of approximately 180 degrees in accordance with the rotation of the rotation shaft 31. The rotation shaft 31 is driven for rotation by an appropriate rotation driving means such as a motor.

Reference numeral 41 denotes a supporting plate which is installed at the end edge part of the reversible plate 30. This supporting plate 41 extends upward. Reference numeral 40 denotes a supporting bed which is fixed to a forward end part of the supporting plate 41. This supporting bed 40 is arranged in its perpendicular posture.

Reference numeral 51 denotes a first driving motor which is mounted on the supporting bed 40. The turning force of this first driving motor 51 is transmitted through a driving sprocket 52. Reference numeral 60 denotes a workpiece supporting shaft which is turnably mounted on the supporting bed 40 through bearings 61, 61. This workpiece supporting shaft 60 projects in a direction of the polishing media storage tank 20 (see FIG. 1). Reference numeral 62 denotes a driven sprocket which is mounted on a rear end part of the workpiece supporting shaft 60. A chain 53 is wound around this driven sprocket 62 and the driving sprocket (of the first driving motor 51) 52, so that the turning force of the first driving motor 51 is transmitted thereto at a reduced speed.

The aluminum-made vehicle wheel W is removably attached to the forward end of this workpiece supporting shaft 60 through an actuator (not shown) and dipped in the polishing media 21, 21, . . . of the polishing media storage tank 20. Thus, in accordance with the revolution of the first driving motor 51, the workpiece supporting shaft 60 is turnable about its axis.

At that time, the aluminum-made vehicle wheel W is held in the state in which its front part is slanted toward the flow of the polishing media 21, 21, . . . (see the state of FIG. 1). The workpiece supporting shaft 60 can intermittently turn normally and reversely.

The vehicle wheel W is of the type in which a rim part 72 is integrally formed around a disc part 71. Windows 73, 73, are formed at this disc part 72.

Reference numeral 80 denotes an advance and retreat rod which is advanceably and retreatably (along the axis) mounted on the supporting bed 40 through bearings 81, 81. This advance and retreat rod 80 is arranged at a lower part of the workpiece supporting shaft 60 in a generally parallel relation. Reference numeral 82 is a basal part. In the advance and retreat rod 80, the basal part 82 is fixed between the bearings 81, 81. Nut members 83, 83 are fixed to this basal part 82.

On the other hand, reference numeral 84 denotes a second driving motor which is mounted on the supporting bed 40. This second driving motor 84 is provided with a reduction mechanism. Reference numeral 85 denotes a bolt pin which is turnably installed on the supporting bed 40 through bearings 86, 86. This bolt pin 85 is turned about the axis by the second driving motor 84. The bolt pin 85 is threadingly engaged with the nut members 83, 83. Owing to this arrangement, when the bolt pin 85 is turned, the nut members 83, 83, and thus the advance and retreat rod 80, are advanced and retracted.

Reference numeral 90 denotes a baffle member which is removably mounted on the forward end of the advance and retreat rod 80. This baffle member 90 is placed in the vicinity of a lower part on the back side of the vehicle wheel W. The baffle member 90 is formed in the shape of a tongue from elastic material such as synthetic resin. Owing to this feature, since the baffle member 90 can easily swing, the endurance of the baffle member 90 can be maintained even if the flow pressure of the polishing media 21, 21, . . . is changed. Moreover, if the baffle member 90 is formed in the shape of a tongue, it can more easily swing and therefore, the endurance of the baffle member 90 can be maintained over a longer period of time. Moreover, since the outer configuration of the peripheral edge of the baffle member 90 is made generally coincident with the configuration of the back side of the vehicle wheel W (see FIG. 1), the surface pressures of the polishing media 21, 21, . . . can be maintained at a generally constant level and therefore, uniformed polishing can be achieved.

Operation of the barrel polishing device B will now be described briefly.

In this barrel polishing device B, the aluminum-made vehicle wheel W is fixed to the forward end of the workpiece supporting shaft 60 and while rotating the same, the vehicle wheel W is sunk in the polishing media 21, 21, . . . of the polishing media storage tank 20. Then, the polishing media 21, 21, . . . , which have passed through the windows 73, 73 of the vehicle wheel W, are mostly stored on the back side of the vehicle wheel W. Then, while rotating and flowing (see the direction as indicated by an arrow of FIG. 4) in accordance with the rotation of the vehicle wheel W, the polishing media 21, 21, . . . flow backward. In this situation, as shown in FIGS. 3 and 4, when the advance and retreat rod 80 is brought to the vicinity of the back side of the disc part 71, the flow of the polishing media 21, 21, . . . is urged against the disc part 71 by the peripheral edge of the baffle member 90 so that this part is polished. Especially, since the corner parts at the back side of a spoke part constituting the window 73 can be simultaneously polished in the shape of R, the coating thickness in the succeeding process can be uniformed. As a result, generation of rust can be prevented and strength can be enhanced by preventing concentration of stress. Moreover, since the baffle member 90 is made advanceable and retractable with respect to the back side of the vehicle wheel W, the surface pressure of the polishing media 21, 21, . . . with respect to the back side of the vehicle wheel W is adjustable.

As the polishing media in this polishing device B, a granular body, a lump or the like of a soft material such as, for example, sponge, rubber, soft plastics and the like can be used. By using selected one of those materials, the finish polishing can be conducted in an efficient manner. It is also accepted that a soft material is coated on the surface of a hard grain, a hard lump or the like, so as to be used as the polishing media.

After the barrel polishing is carried out, a surface treatment such as coating, plating and anodizing is conducted. Those surface treatments include all of the normally available treatments.

Although a vehicle wheel is employed as a workpiece in this embodiment, the present invention is not limited to it. Needless to say, all objects to be polished can be included therein.

FIG. 5 shows another embodiment of the present invention. In this embodiment, the workpiece supporting shaft 60 is arranged perpendicular to the flowing direction of the polishing media 21. In this embodiment, the polishing media 21 flow along the front and back surfaces of the vehicle wheel W. The polishing media 21 flowing along the back surface of the vehicle wheel W are urged against the disc part 71 by the peripheral edge of the baffle member 90, so as to polish this part.

When the vehicle wheel W enters the polishing media downward, the polishing media 21 flow from the front surface to the back surface and therefore, the same effect as in the above-mentioned embodiment can be obtained.

Figure 6:
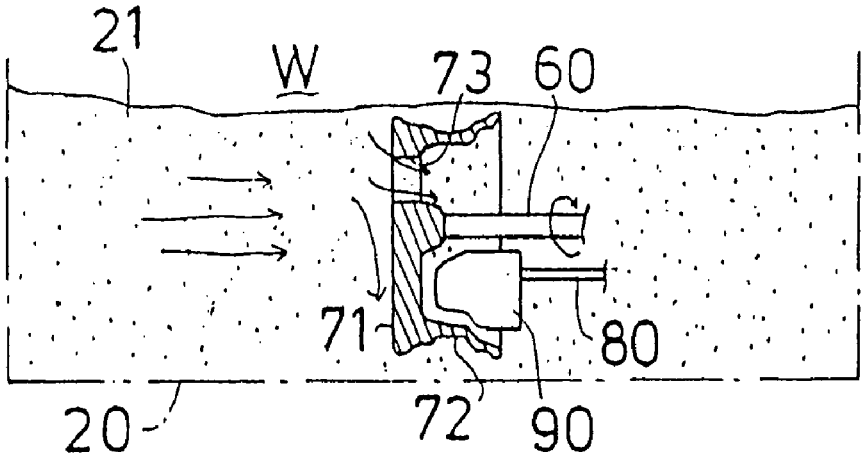
FIG. 6 is a view like FIG. 1 but showing a further embodiment of the present invention.

FIG. 6 shows a further embodiment of the present invention. In this embodiment, the workpiece supporting shaft 60 is arranged horizontal to the flowing direction of the polishing media 21. The polishing media 21 are collided with the front surface of the vehicle wheel W and mostly stored on the back side of the vehicle wheel W after passing through the windows 73, 73, . . . . At this time, as shown in FIG. 6, when the advance and retreat rod 80 is brought to the vicinity of the back side of the disc part 71, the flow of the polishing media 21, 21, . . . is urged against the disc part 71 by the peripheral edge of the baffle member 90, so as to polish this part. As a means for turning the workpiece supporting shaft 60, the conventionally available drive transmitting means (rotation transmitting means in the perpendicular direction) such as a bevel gear is used. Similarly, as a means for advancing and retreating the advance and retreat rod 80, a conventionally available drive transmitting means (means for converting a rotating motion into an advancing and retreating motion) such as a rack and a pinion is used.

As mentioned above, since a barrel polishing device according to the present invention is effectively used for a member which needs a polishing effect on the back side such as a vehicle wheel because it is excellent in polishing effect at the back side of a rotating workpiece.

What is claimed is:

1. A barrel polishing device, comprising:

a polishing media storage tank for storing polishing media, said polishing media being flowed by rotation of the polishing medium storage tank;

a base;

a workpiece supporting shaft mounted on said base and being rotated about an axis thereof;

a workpiece detachably mounted on a tip part of said workpiece supporting shaft; and a baffle member which is placed in the vicinity of a back side of said workpiece;

wherein said workpiece supporting shaft being disposed so that a front side of said workpiece opposes to the flow of said polishing media;

and wherein said baffle member is capable of advancing and retracting with respect to the back side of said workpiece.

2. A barrel polishing device according to claim 1, wherein said workpiece has a window.

3. A barrel polishing device according to claim 1, wherein said baffle member is formed of an elastic material.

4. A barrel polishing device according to claim 3, wherein said baffle member is formed in the shape of a tongue.

5. A barrel polishing device according to claim 3, wherein an outer configuration of said baffle member is generally coincident with a configuration of the back side of said workpiece.

6. A barrel polishing device, comprising:

a polishing media storage tank for storing polishing media, said polishing media being flowed by rotation of the polishing medium storage tank;

a base;

a workpiece supporting shaft mounted on said base and being rotated about an axis thereof;

a workpiece detachably mounted on a tip part of said workpiece supporting shaft; and a baffle member which is placed in the vicinity of a back side of said workpiece;

wherein said workpiece supporting shaft being disposed so that a front side of said workpiece opposes to the flow of said polishing media;

and wherein said baffle member is placed in the vicinity of a lower part of the back side of said workpiece.

* * * * *